US006406126B1

(12) United States Patent
Clark

(10) Patent No.: US 6,406,126 B1
(45) Date of Patent: Jun. 18, 2002

(54) MULTIPLE HEAD INKJET PRINTER FOR PRODUCING ADJACENT IMAGES

(75) Inventor: David L. Clark, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/645,703

(22) Filed: Aug. 24, 2000

(51) Int. Cl.[7] ..... B41J 3/54
(52) U.S. Cl. ..... 347/37
(58) Field of Search ..... 347/37, 20, 24, 347/29, 40, 43, 56, 57

(56) References Cited

U.S. PATENT DOCUMENTS

| | | | | |
|---|---|---|---|---|
| 4,595,303 | A | 6/1986 | Kuzuya et al. | 400/82 |
| 4,709,247 | A | 11/1987 | Piatt et al. | 347/40 |
| 5,289,208 | A | 2/1994 | Haselby | 347/19 |
| 5,297,017 | A | 3/1994 | Haselby et al. | 347/19 |
| 5,644,344 | A | 7/1997 | Haselby | 347/19 |
| 5,864,349 | A | 1/1999 | Hirabayashi et al. | 347/39 |
| 5,870,117 | A | 2/1999 | Moore | 347/37 |
| 5,966,145 | A | 10/1999 | Miura et al. | 347/9 |
| 5,992,972 | A | 11/1999 | Nagoshi et al. | 347/43 |
| 6,000,781 | A | 12/1999 | Akiyama et al. | 347/40 |

FOREIGN PATENT DOCUMENTS

| | | |
|---|---|---|
| JP | 6-77246 | 3/1994 |

*Primary Examiner*—Anh T. N. Vo
(74) *Attorney, Agent, or Firm*—Norman Rushefsky

(57) ABSTRACT

A multiple-head inkjet printer is provided for producing adjacent images on a printing medium. The inkjet printer includes a carriage, a plurality of inkjet printhead axially movable along the carriage and spaced predetermined axial distances from one another, and a printhead driver assembly for simultaneously moving each of the printheads along the carriage while maintaining the spacing distances between adjacent printheads. Each inkjet printhead is controlled by a separate image driver circuit to allow each printhead the capability of independently printing a separate image on the printing medium. The carriage has a length sufficiently greater than the width of the printing medium to allow a single one of the printheads to print a single a large image extending completely across the printing medium. The inkjet printer finds particular application in a photographic micro lab.

20 Claims, 6 Drawing Sheets

MULTIPLE HEAD INKJET PRINTER FOR PRODUCING ADJACENT IMAGES

BACKGROUND OF THE INVENTION

This invention generally concerns inkjet printers, and is specifically concerned with a multiple-head inkjet printer for use in a photographic mini-lab that is capable of producing either separate adjacent images or a single image across the width of a printing medium.

Photographic mini-labs capable of rapidly providing photographic prints from color film are well known in the prior art. However, because of the cost of the silver halide paper and chemicals that such photographic prints are based upon, the resulting prints are relatively expensive on a per area basis compared with image prints produced by color inkjet printers which use relatively inexpensive inks and papers. Additionally, inkjet printing processes are inherently faster than photographic printing process since they do not require time consuming chemical development steps. As the cost of inkjet printers drops and the quality of the resulting printed images improves, there is a growing interest in the development of mini-labs capable of producing photographic-quality prints from such printers. Such a printer-based mini-lab would have the added advantage of providing the consumer with a number of image modification options which are either unavailable or impractical in the context of a silver-halide based mini-lab. For example, the originally-captured digital image could be displayed on a computer monitor prior to printing to allow the consumer to crop, blow up, vignette, shade, or reduce some or part of the image. The overall color tint and intensity of the image could be easily controlled and selected in much the same manner that the tint and color intensity of a color television is adjusted. However, in order for such a digitally controlled, inkjet-type mini lab to be commercially desirable, it must also be capable of rapidly producing prints of different sizes (i.e., 4×6, 6×8, 8×10 inch prints, etc.). Since the orifice plate of a typical commercially available inkjet printhead is, at most, only about 1 inch long and includes a maximum of only about 1000 inkjet orifices, the use of a plurality of printheads is necessary to obtain a high production rate.

While it is not difficult in principal to coordinate a plurality of such printheads to print multiple adjacent images across a printing medium (such as, for example, two or three adjacent 4×6 images), problems arise when such a multiple array of printheads are coordinated to print larger images. For example, if one attempts to construct an end-to-end abutment of the nozzle plates of several printheads to form the equivalent of a single large printhead, mechanical interference between the edges of the printheads make such an abutted configuration impractical, if not impossible. Alternatively, several printheads could be overlapped in a staggered configuration such that their respective orifice plates are aligned along an axis transverse to the printing medium. However, such a staggered alignment must be done to tolerances of at least 1/1000 of an inch in order to avoid the creation of line-shaped printing errors between the printheads which are readily detectable by the human eye. And even if such mechanical alignment were achieved, linear printing errors can also occur as a result of slight angular misalignments between the staggered array of printing heads and the printing medium as it is continuously moved relative to the printheads during the printing operation. Finally, the digital imaging and control circuitry necessary to implement the production of a single, integrated image from a multiple array of printheads is relatively complex and hence more apt to generate imaging errors. Of course, all of the aforementioned problems could be obviated by the creation of a printhead whose orifice plate was as wide as the printing medium moved beneath it. Unfortunately, it is difficult to manufacture orifice plates more than approximately 1 inch long without the introduction of small misalignments of the inkjets along the longitudinal axis of the plate which in turn could produce perceptible imaging errors.

Clearly, there is a need for a multiple-head inkjet printer that is capable of producing photographic-quality color images on a printing medium in a variety of sizes without the introduction of linear imaging errors and without the need for high-precision mechanical alignments between the printheads and the printing medium. Preferably, such a printer could be assembled largely from inexpensive and commercially available printheads. Ideally, such a printer could be operated by way of simple, reliable and inexpensive printing circuitry.

SUMMARY OF THE INVENTION

Generally speaking, the invention is a multiple-head inkjet printer that eliminates or at least ameliorates all of the aforementioned shortcomings associated with the prior art. The inkjet printer comprises a carriage having an axis traversing a printing medium, a plurality of inkjet printheads axially movable along the carriage and spaced apart from one another, each printhead being capable of independently printing a separate image on the printing medium, and a printhead driver assembly for simultaneously moving each of the printheads along the carriage equal axial distances while maintaining a spacing distance between the printheads.

The carriage has a length along its axis sufficiently greater than the width of the printing medium to allow a single one of the printheads to print a single image that extends completely across the printing medium. Hence, in one mode of operation, the plurality of inkjet printheads can simultaneously print adjacent, independent images across the width of the printing medium. In another mode of operation, a single printhead may print a single relatively large image completely across the width of the printing medium, thus avoiding the problems associated with printing a single image with multiple printheads. Of course, an intermediate mode of operation is also possible wherein less than all of the plurality of inkjet printheads are used to print fewer but larger images across the width of the printing medium.

In the preferred embodiment, the inkjet printer includes a rotatably mounted carrier drum for moving the printing medium across the transverse axis of the carriage. The width of the printing medium is preferably the same or slightly greater than the width of the carrier drum so that the edges of the medium are even with or overlap the edges of the drum. Such a configuration avoids the spraying of ink from the printheads onto the edges of the carrier drum.

The printhead driver assembly may include a lead screw threadedly engaged to each of the plurality of inkjet printheads in combination with a reversible stepper motor. The output shaft of the stepper motor is preferably engaged to the lead screw via a gear train. The motor driven lead screw serves to slidably drive the plurality of inkjet printheads back and forth across the carriage in shuttle fashion during a printing operation, while maintaining the same spacing distances between adjacent printheads.

The inkjet printer may also include caps detachably connectable over the inkjet nozzles of printheads which are not used in a printing operation where fewer than all of the printheads are used to simultaneously print one or more images across the width of the printing medium. Alternatively, the control circuit of the printer assembly may be programmed so that ink droplets are expelled from the nozzles of such unused printheads whenever these printheads are slidably moved away from the printing medium during such a printing operation. In either case, problems are avoided which might otherwise occur if ink were allowed to dry in the inkjet orifices of the printhead not used during such a mode of operation.

DETAILED DESCRIPTION OF THE INVENTION

Figure 1:
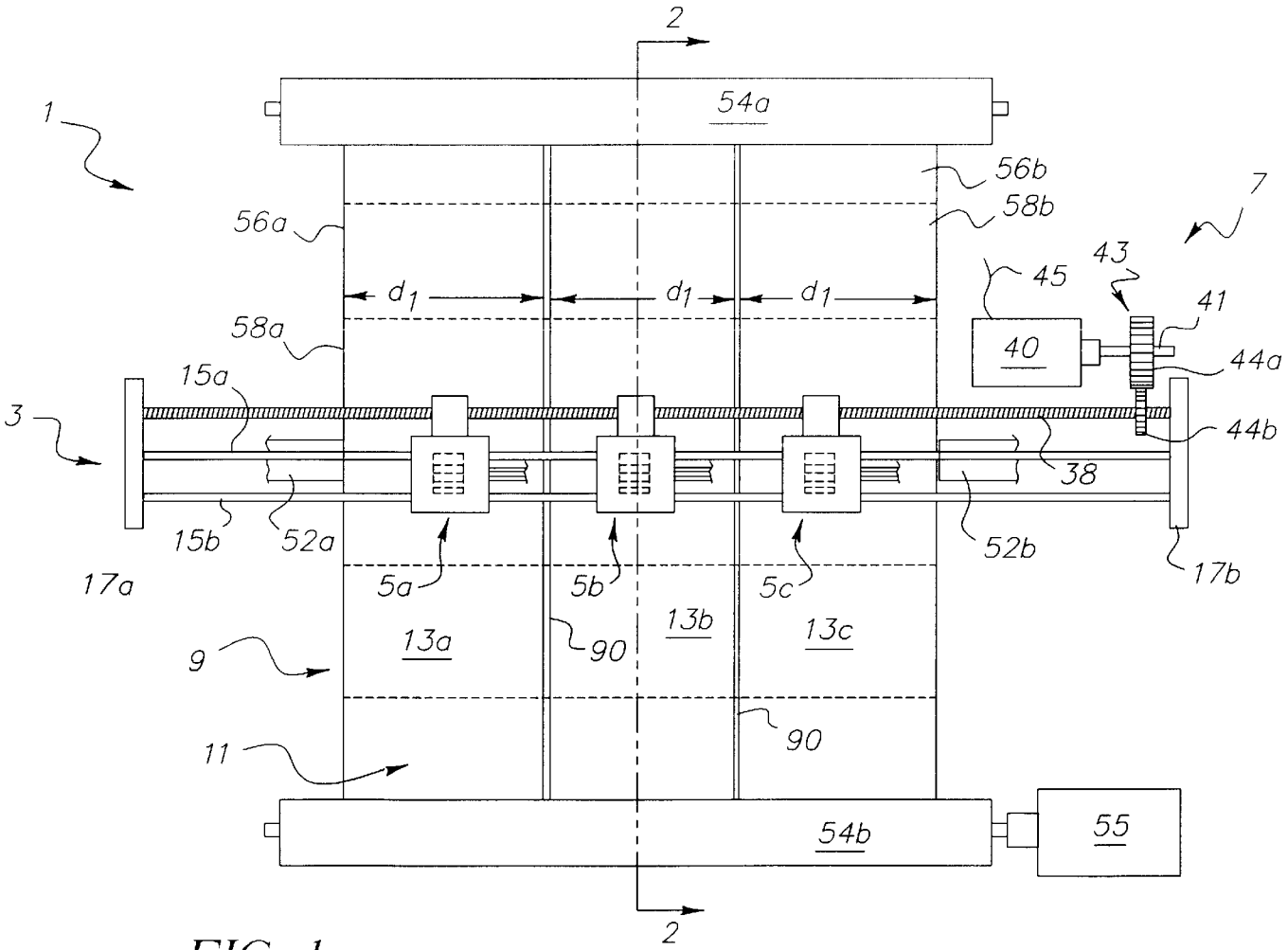
FIG. 1 is a plan view of the inkjet printer of the invention, illustrating how each one of the printheads is used to print adjacent, independent images across the width of a printing medium.
Figure 2:
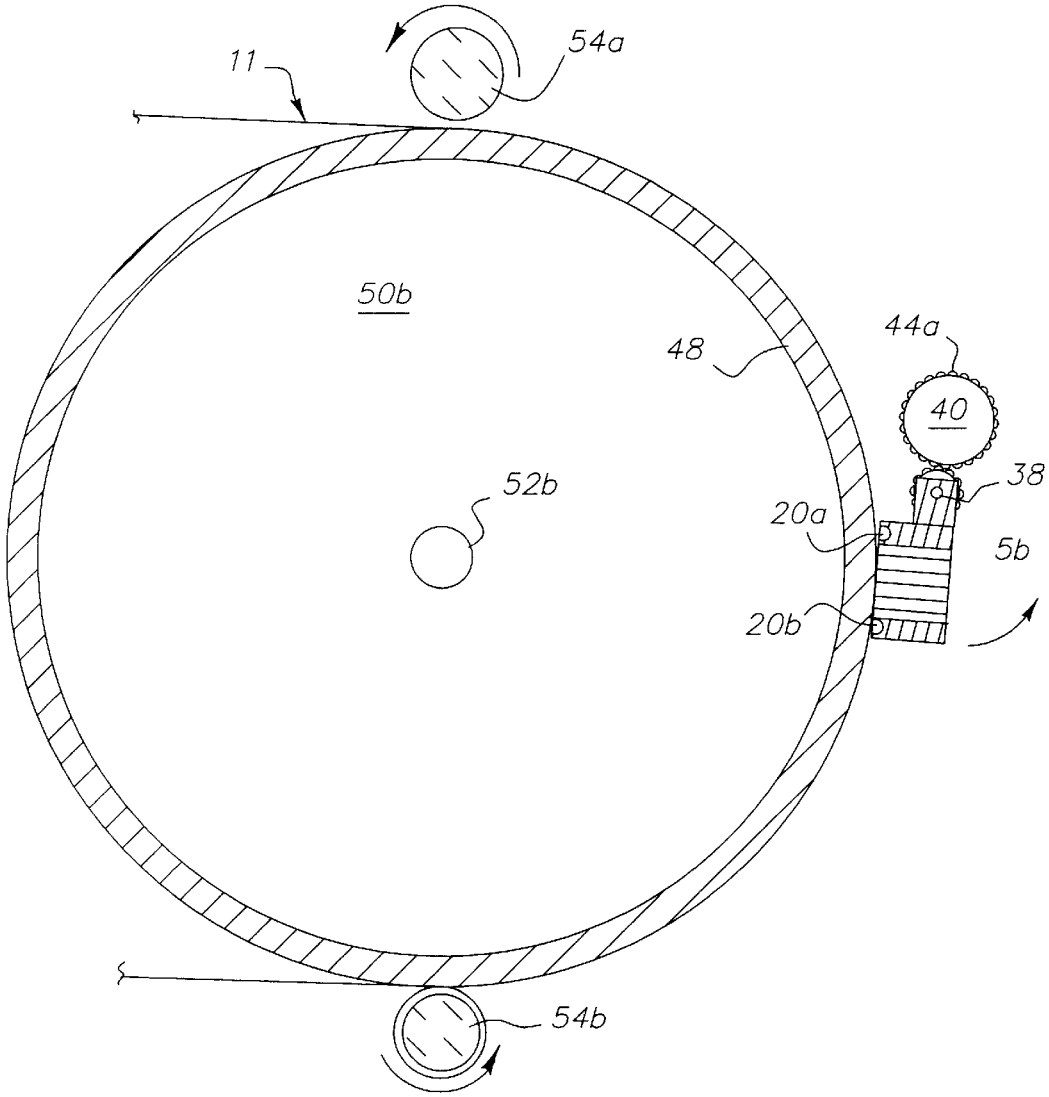
FIG. 2 is a cross-sectional side view of the printer of FIG. 1 along the line 2—2.

With reference now to FIGS. 1 and 2, wherein like reference numerals designate like components throughout all of the several Figures, the multi-head inkjet printer 1 of the invention generally comprises an elongated carriage 3 onto which printheads 5*a–c* are slidably mounted. While three printheads are used in this preferred embodiment, any number of printheads over two is within the scope of the invention. The printer 1 further comprises a driver assembly 7 for slidably moving the printheads 5*a–c* transversely across a carrier drum 9 which supports and feeds a strip of printing medium (which is preferably paper) transversely across the longitudinal axis of the carriage 3. While not specifically shown in FIG. 2, the carrier drum 9 may include a heating mechanism for facilitating the drying of the resulting printed images 13*a–c*.

The carriage 3 includes a pair of parallel rails 15 connected and supported by side plates 17*a,b*. It is important that the axial length of the carriage 3 be sufficiently long so that one of the printheads (such as printhead 5*b*) is free to move completely across the width of the printing medium in the manner illustrated in FIG. 6. As will be described in more detail hereinafter, such dimensioning of the carriage 3 allows the printer 1 of the invention to produce single, large images that extend completely across the width of the printing medium 11 without the type of linear imaging errors which occurred in the prior art as the result of the combined use of two or more printheads to print such an image.

Figure 3:
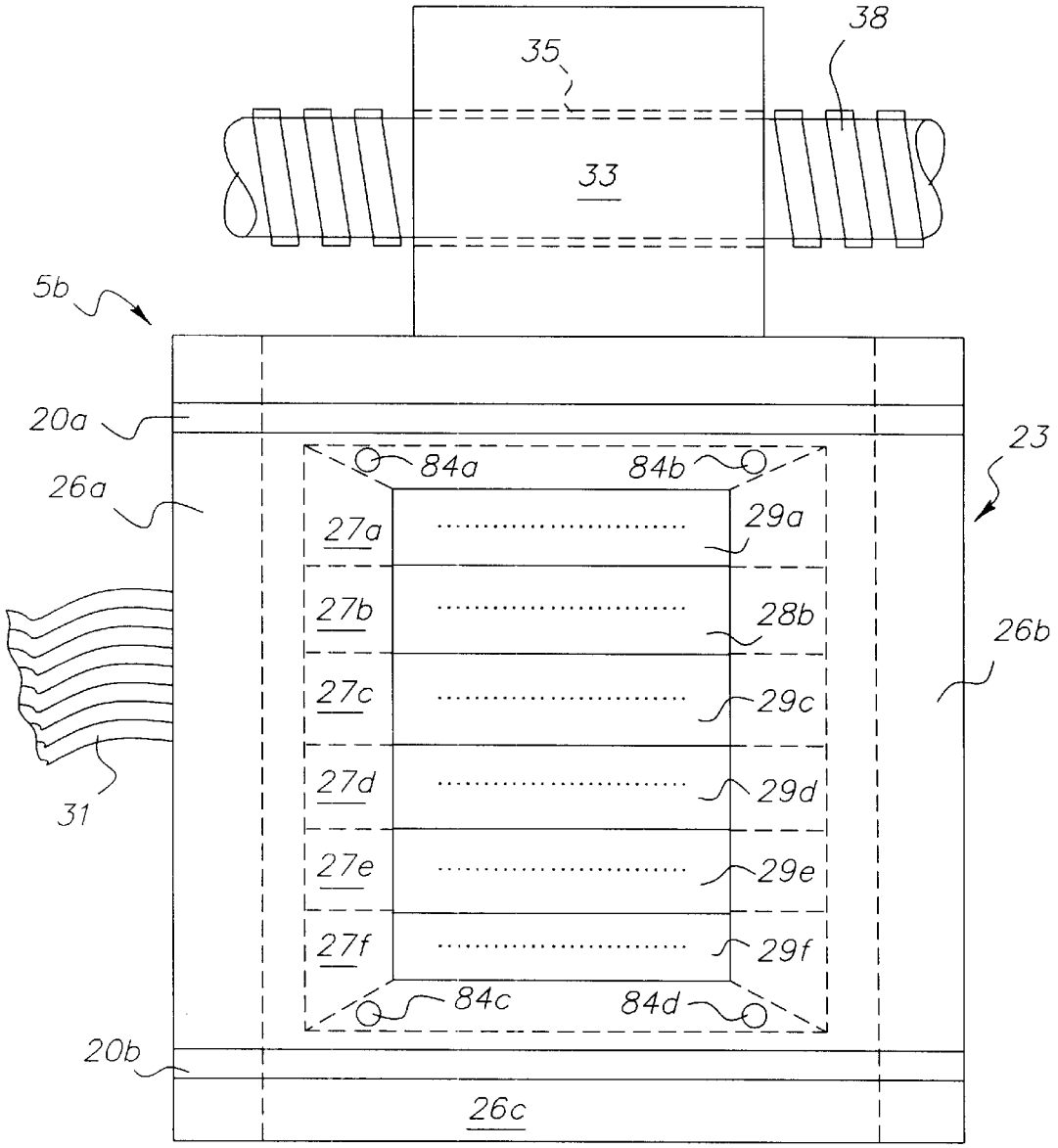
FIG. 3 is a plan view of the underside of one of the inkjet printheads used in the printer, illustrating its six aligned orifice plates.
Figure 5:
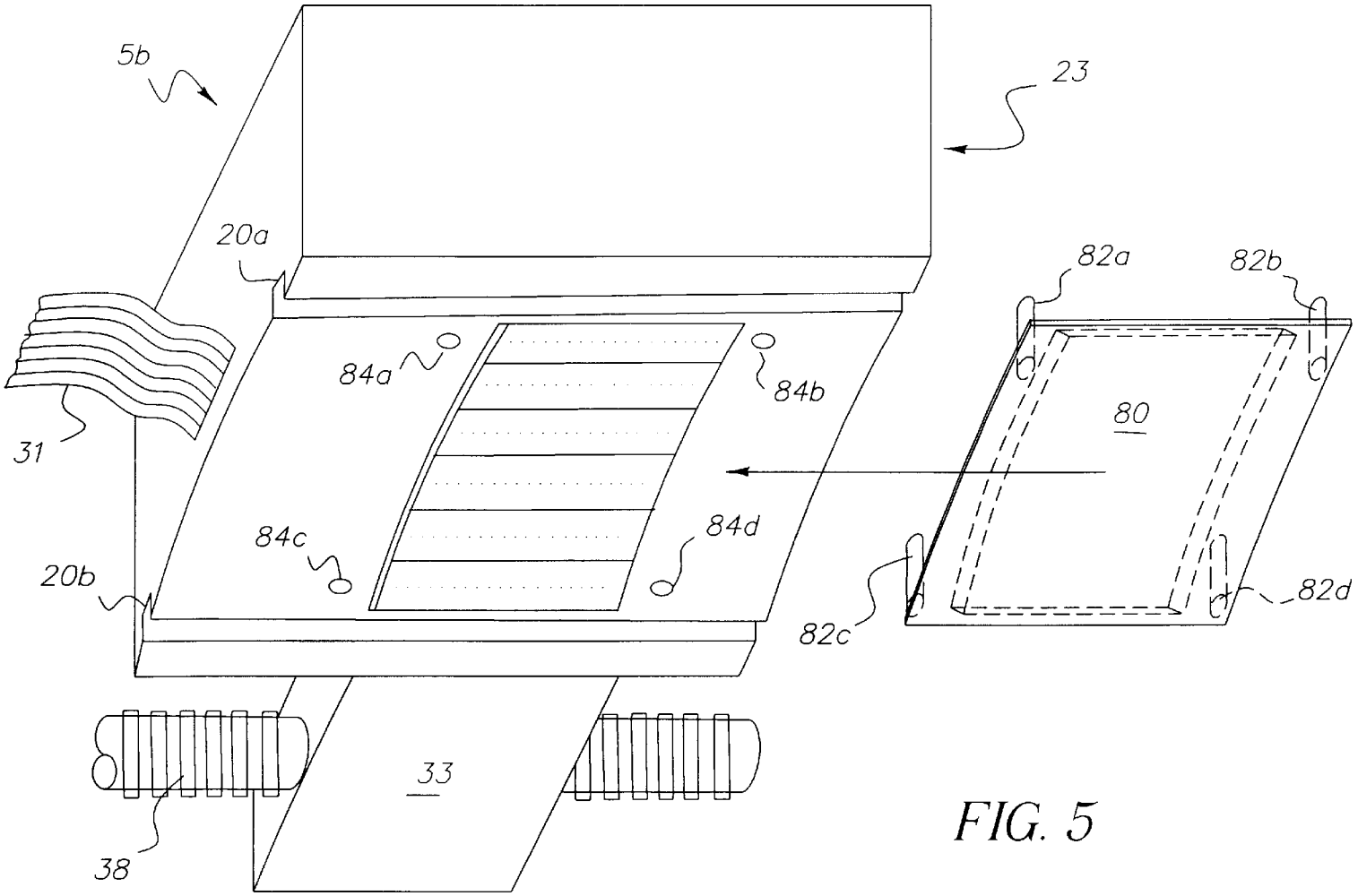
FIG. 5 is a perspective view of the underside of one of the inkjet printheads used in the printer, illustrating how a detachably mountable cap may be placed over the orifice plates of a printhead in order to prevent ink from drying therein when the printhead is not in use.

With reference in particular to FIGS. 1 and 3, each of the printheads 5*a–c* includes a pair of parallel rail slots 28*a,b* for receiving the rails 15*a,b* of the carriage 3. Each of the printheads 5*a–c* is formed from a generally square housing 23 (preferably formed from a plastic material) having four orthogonal side walls 26*a–d*. The housing 23 contains six inkjet cartridges 27*a–f*, each of which includes its own ink reservoir, orifice control circuitry, and orifice plate 29*a–f*. The six inkjet cartridges, 27*a–f* respectively print black ink, dark cyan ink, light cyan ink, dark magenta ink, light magenta ink, and yellow ink, respectively. The inks are preferably water based. The orifice plates 29*a–f* are aligned in a stacked configuration as illustrated in FIG. 5 in order to simplify the printing operation. Each orifice plate 29*a–f* preferably includes at least 300 nozzles which are capable of generating ink droplets between 5 and 100 pico-liters in volume. Additionally, each inkjet cartridge 27*a–f* is preferably capable of printing at a greyscale of 13 drop sizes per pixel at a single drop firing rate of 24 kilohertz. Printheads conforming to the aforementioned specifications are presently available from a variety of manufacturers, including (but not limited to) Hewlett-Packard, Epsom, and Brother. The operation of each of the individual inkjet cartridges 27*a–f* and each of the printheads 5*a–c* is controlled via electrical pulses conducted through a ribbon-type control cable 31.

The upper side wall 26*d* of the printhead housing 23 is integrally connected to a lug 33 that includes a threaded bore 35. Bore 35 is threadedly engaged to a lead screw 38 that forms part of the driver assembly 7. Lead screw 38 is rotatably mounted on either end in the side plates 17*a,b* of the carriage 3 as shown. One end of the lead screw 38 is connected to the output shaft 41 of a reversible stepper motor 40 through a drive train 43. The drive train 43 includes a pair of intermeshing gear wheels 44*a,b*. A control cable 45 is connected to the reversible stepper motor 40 to conduct power pulses of different frequencies and polarities in order to turn the output shaft 41 in different directions and speeds.

With reference again to FIGS. 1 and 2, the carrier drum 9 of the printer 1 is formed from an annular support wall 48 flanked by a pair of circular side walls 50*a,b*. Stub axles 52*a,b* project along the axis of rotation of the circular side walls 50*a,b* to allow the drum 9 to be rotatably mounted. Although not shown in FIG. 2, a heater may be provided to heat up the annular support wall 48 in order to facilitate the rapid drying of prints rendered on the printing medium 11. An upper feed roller 54*a* is provided to maintain the printing medium 11 flat against the outer surface of the annular support wall 48, while a lower feed roller 54*b* is connected to a feed motor 55 and serves to turn the drum 9 in a counterclockwise direction during the printing process. Importantly, the width of the printing medium 11 is dimensioned so that its side edges 56*a,b* are even with, or slightly overlap the side edges 58*a,b* of the annular support wall 58. Such dimensioning insures that the outer edges of the annular support wall 48 will not be sprayed with ink from the printheads 5*a–c* during a printing operation.

Figure 4:
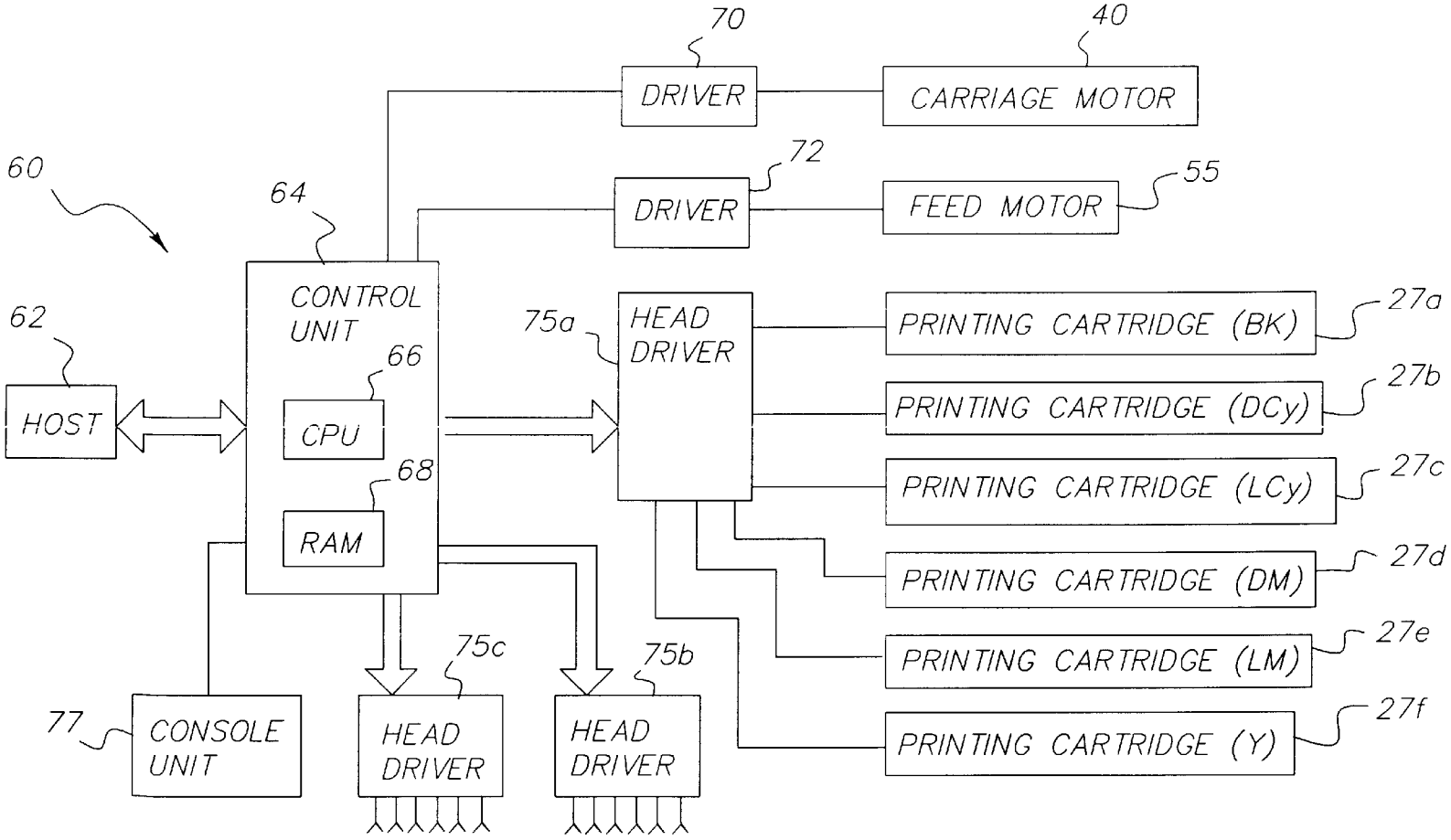
FIG. 4 is a schematic diagram of the control circuitry used to operate the printer.

With reference now to FIG. 4, a printer control circuit 60 is provided for controlling the printing operations of the printheads 5*a–c*. Circuit 60 includes a host circuit 62 which supplies digital image data to control unit 64. Host 62 may be, for example, a film scanner, a digital camera, a digital image archiving station, a personal computer, etc. Control unit 64 includes both a central processing unit 66 (CPU), and a memory circuit 68 for storing the image data received from the host 62. The control unit 64 controls the driver circuits 70,72 which supply power pulses to the carriage motor 40 and feed motor 55, respectively. Finally, the control unit 64 controls head driver circuits 75*a–c* which control the specific printing operations of the printheads 5*a–c* respectively. Each of the head driver circuits controls and number and size of ink droplets generated by each of the six printing cartridges included within the printheads 5*a–c*. However, in order to simplify the diagram, the connections between the head driver circuit and the printing cartridges is illustrated only with respect to head driver circuit 75*a*. To complete the control circuit 60, a console unit 77 (which may be a keyboard) provides a user interface to the control unit 64.

With reference now to FIGS. 2 and 5, the underside of each of the printheads 5*a–c* is slightly curved in order to match the profile of the carrier drum 9. Additionally, each of the printheads 5*a–c* may be pivotally turned upwardly in the direction of the arrow present in FIG. 2 so that a detachably mountable cap 80 may be installed over the orifice plates 29*a–f*. As will become more evident hereinafter, the installation of such a cap 80 advantageously prevents the inkjet orifices in the plates 29*a–f* from drying out when less than all of the printheads 5*a–c* is used in a printing operation. Plate cap 80 includes four posts 80*a–d* which are snap-fittable in holes 84*a–d* present all on the underside of printheads 5*a–c*. A sponge element 86 saturated with a wetting agent is provided on the side of the cap 80 facing the printhead 5*b* so that the element 86 engages the orifice plates 29*a–f* when the posts 82*a–d* are inserted into holes 84*a–d*.

In the first mode of operation of the printer 1 illustrated in FIG. 1, the control circuit 60 instructs each one of the printheads 5*a–c* to print a complete image having a width of distance d1 across the printing medium 11. Simultaneously, the control unit 60 drives the carriage motor 40 so that the printheads 5*a–c* move in a shuttle-like fashion across the printing medium 11, which is moved in a direction transverse to the longitudinal axis of the carriage 3 via carrier drum 9. The printheads 5*a–c* produce their respective, separate images 13*a–c* simultaneously. Because the resulting image prints 13*a–c* are divided by narrow borders 90, the need for precise mechanical alignments and controls is lessened. At the end of the printing operation, the printing medium 11 is removed from the drum 9, and the individual printed images are removed by conventional slitting and chopping techniques.

Figure 6:
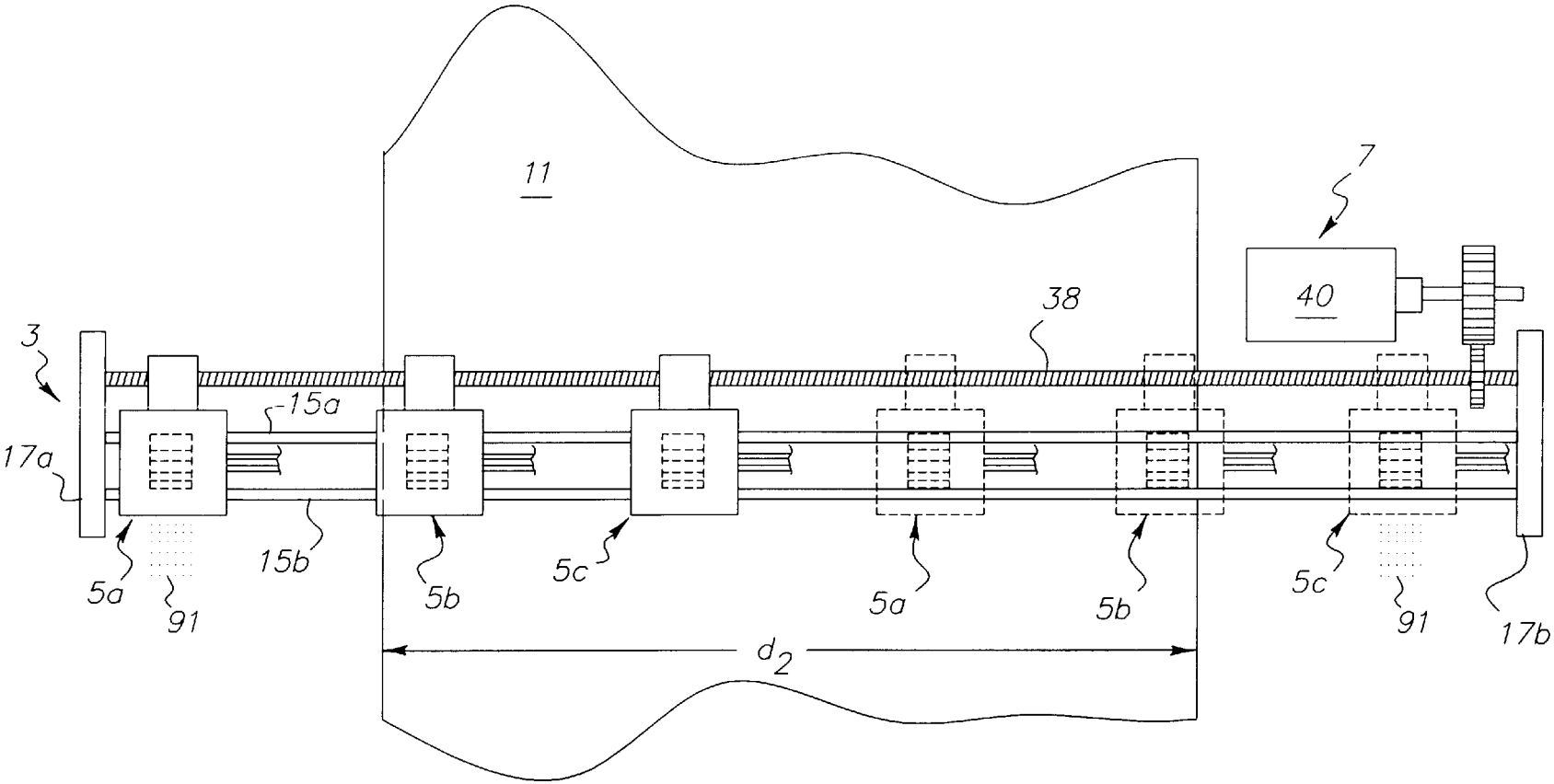
FIG. 6 is a plan view of the printer of the invention operating in a different printing mode than in FIG. 1, wherein a single printhead is used to print a single large image across the width of the printing medium.

A second mode of operation of the printer 1 is illustrated in FIG. 6. Here, the center printhead 5*b* is moved in shuttle-like fashion a distance d2 completely across the printing medium 11 to generate a single, large image. Again, the need for precise mechanical alignments between the various printheads 5*a–c* and the carriage 3 is obviated, since only a single printhead (as opposed to multiple coordinated printheads) prints the image. The axial length of the carriage 3 has been deliberately chosen so that the unused printheads 5*a,c* are free to move over the edge of the printing medium 11 during this mode of operation without colliding with the carriage side plates 17*a,b*.

FIG. 6 also illustrates another means by which the drawing of ink in the orifices of the unused printheads 5*a,c* may be avoided. In lieu of the previously described plate cap 80, the control circuit 60 may be programmed to spray a few random drops of ink through all of the orifice plates 29*a–f* whenever one of the unused printheads 5*a,c* is moved away from the printing medium 11 in a position adjacent to one of the side plates 17*a* or 17*b*. The spraying of a few ink droplets through each of the orifice plates 29*a–f* of the unused printheads 5*a,c* while printhead 5*b* proceeds to generate its single large image across the width of the printing medium 11 will prevent ink from drying in the orifice plates of the printheads 5*a,c* in just as effective a manner as the placement of plate cap 80 would.

While this invention has been described in the context of a preferred embodiment, many variations, modifications, and additions are possible. For example, the number of printheads used may vary from between two to as many as six, or more. The lead screw 38 of the driver assembly 7 may be replaced with a gear train and belt arrangement which generates shuttle-like movements in the same manner while maintaining the same spacing distances between the printheads. The carrier drum may further be replaced with a scroll-type device which moves the printing medium 11 transversely with respect to the axis of the carriage 3. Alternatively, the printing medium 11 may remain stationary, and the carriage 3 may be moved. All such variations, modifications, and additions are encompassed within the scope of this invention, which is limited only by the claims appended hereto.

PARTS LIST

| | |
|---|---|
| 1. | Multi-head inket printer |
| 3. | Carriage |
| 5. | Printheads a, b, c |
| 7. | Driver assembly |
| 9. | Carrier drum |
| 11. | Printing medium |
| 13. | Adjacent images a–c |
| 15. | Parallel rails a, b |
| 17. | Side plates a, b |
| 20. | Rail slots a, b |
| 23. | Housing |
| 26. | Side walls a, b, c, & d |
| 27. | Inkjet cartridge a, b, c, d, e, f |
| 29. | Orifice plates a–f |
| 31. | Control cable |
| 33. | Lug |
| 35. | Threaded bore |
| 36. | [Driver assembly] |
| 38. | Lead screw |
| 40. | Reversible stepper motor |
| 41. | Output shaft |
| 43. | Drive train |
| 44. | Gears a, b |
| 45. | Control cable |
| 48. | Annular support wall |
| 50. | Circular side walls a, b |
| 52. | Stub axles a, b |
| 54. | Feed rollers a, b |
| 55. | Feed motor |
| 56. | Side edges a, b (of printing medium 11) |
| 58. | Side edges a, b (of annular support wall) |
| 60. | Printer control circuit |
| 62. | Host |
| 64. | Control unit |
| 66. | CPU |
| 68. | Memory circuit |
| 70. | Driver (carriage motor) |
| 72. | Driver (feed motor) |
| 75. | Printhead drivers a, b, c |
| 77. | Console unit |
| 80. | Detachably mountable plate cap |
| 82. | Post a–d |
| 84. | Holes a–d |
| 86. | Sponge element |

What is claimed is:

1. An inkjet printer particularly adapted for producing adjacent images on a printing medium, comprising:

a carriage having an axis traversing the printing medium of predetermined width;

a plurality of inkjet printheads axially movable along said carriage and spaced predetermined axial distances from one another such that the printheads are adapted to independently print separate images on said printing medium, and a printhead driver assembly for simultaneously moving each of said printheads along said carriage equal axial distances while maintaining said predetermined spacing distances between said printheads, said carriage axis having a length sufficiently greater than the width of said printing medium such that less than all of said plurality of printheads are adapted to print one or more images that extend completely across said printing medium width.

2. The inkjet printer defined in claim 1, wherein said carriage axis has a length sufficiently greater than the width of said printing medium such that a single one of said printheads is adapted to print an image extending completely across said printing medium width.

3. The inkjet printer defined in claim 1, wherein at least three of said inkjet printheads are uniformly spaced apart by equal axial distances.

4. The inkjet printer defined in claim 1, further comprising a rotatably mounted carrier drum for moving said printing medium across said transverse axis of said carriage.

5. The inkjet printer defined in claim 4, wherein said printing medium includes opposing edges that are aligned with or slightly overlap opposing edges of said drum to isolate said drum edges from ink sprayed by said printheads.

6. The inkjet printer defined in claim 1, wherein said printhead driver assembly includes a lead screw that threadedly engages said printheads for simultaneously moving each of said printheads along said carriage equal axial distances.

7. The inkjet printer defined in claim 6, wherein said printhead driver assembly includes a reversible stepper motor for driving said lead screw.

8. The inkjet printer defined in claim 1, wherein each of said printheads includes inkjet nozzles, and further comprising a means for preventing the inkjet nozzles of printheads not used to print adjacent images from drying out.

9. The inkjet printer defined in claim 8, wherein said means includes a cap detachably connectable over said inkjet nozzles.

10. An inkjet printer particularly adapted for producing adjacent images on a printing medium comprising:

a drum for carrying the printing medium of predetermined width;

a carriage having an axis transversing said drum-carried printing medium;

a carriage having an axis traversing a printing medium;

a plurality of inkjet printheads axially movable along said carriage and spaced predetermined axial distances from one another such that the printheads are adapted to independently print separate images on said printing medium, and wherein said carriage axis has a length sufficiently greater than the width of said printing medium to allow less than all of said plurality of printheads to print one or more images that extend completely across said printing medium width.

11. The inkjet printer defined in claim 10, wherein said carriage axis has a length sufficiently greater than the width of said printing medium such that a single one of said printheads is adapted to print an image extending completely across said printing medium width.

12. The inkjet printer defined in claim 10, wherein at least three of said inkjet printheads are uniformly spaced apart by equal axial distances.

13. The inkjet printer defined in claim 10, wherein said printing medium includes opposing edges that are aligned with or slightly overlap opposing edges of said drum to isolate said drum edges from ink sprayed by said printheads.

14. The inkjet printer defined in claim 10, wherein said printhead driver assembly includes a lead screw that threadedly engages said printheads for simultaneously moving each of said printheads along said carriage equal axial distances, and wherein said printhead driver assembly includes a reversible stepper motor for driving said lead screw.

15. The inkjet printer defined in claim 10, wherein each of said printheads includes inkjet nozzles, and further comprising a means for preventing the inkjet nozzles of printheads not used to print adjacent images from drying out.

16. The inkjet printer defined in claim 15, wherein said means includes a cap detachably connectable over said inkjet nozzles.

17. The inkjet printer defined in claim 15, wherein said means includes a driver circuit for each unused printhead for spraying ink through said inkjet nozzles when said printhead driver assembly moves said unused printheads in a position away from said printing medium.

18. The inkjet printer defined in claim 1, wherein each printhead includes a plurality of nozzle plates, each of which has a row of inkjet nozzles.

19. The inkjet printer defined in claim 18, wherein each printhead includes a separate ink supply of different colors for each nozzle plate so that each printhead can print a color image.

20. The inkjet printer defined in claim 10, further comprising a separate image driver circuit for each of said printheads.

* * * * *